US007197883B2

(12) United States Patent
Gasteyer, III et al.

(10) Patent No.: US 7,197,883 B2
(45) Date of Patent: Apr. 3, 2007

(54) COOLING OR HEATING WITH MULTI-PASS FLUID FLOW

(75) Inventors: Theodore Hall Gasteyer, III, Naperville, IL (US); Gary Dee Lang, Naperville, IL (US); John Girard, Downers Grove, IL (US)

(73) Assignee: Praxair Technology, Inc., Danbury, CT (US)

( * ) Notice: Subject to any disclaimer, the term of this patent is extended or adjusted under 35 U.S.C. 154(b) by 121 days.

(21) Appl. No.: 11/123,906

(22) Filed: May 6, 2005

(65) Prior Publication Data

US 2006/0248913 A1 Nov. 9, 2006

(51) Int. Cl.
*F25D 13/06* (2006.01)

(52) U.S. Cl. ..... 62/63; 62/374; 62/380; 198/952

(58) Field of Classification Search ..... 62/52.1, 62/62, 63, 186, 266, 347, 374, 378, 380; 198/952; 99/386, 517
See application file for complete search history.

(56) References Cited

U.S. PATENT DOCUMENTS 3,892,104 A * 7/1975 Klee et al. ..... 62/186
3,898,863 A 8/1975 Wagner ..... 62/208
4,385,700 A * 5/1983 Hodges et al. ..... 209/539
4,475,351 A 10/1984 Klee ..... 62/63
4,479,776 A * 10/1984 Smith ..... 432/144
4,627,244 A * 12/1986 Willhoft ..... 62/63
4,783,972 A * 11/1988 Tyree et al. ..... 62/374
4,800,728 A 1/1989 Klee ..... 62/63
4,852,358 A 8/1989 Acharya et al. ..... 62/63
5,444,985 A * 8/1995 Lang et al. ..... 62/63
5,487,908 A * 1/1996 Appolonia et al. ..... 426/520
5,605,049 A 2/1997 Moore et al. ..... 62/63
5,740,678 A 4/1998 Lee et al. ..... 62/63
5,765,381 A * 6/1998 Renz ..... 62/63
5,813,237 A 9/1998 Grace et al. ..... 62/52.1
6,263,680 B1 7/2001 Newman et al. ..... 62/63
6,263,681 B1 * 7/2001 Laut ..... 62/63
6,334,330 B2 1/2002 Lang et al. ..... 62/374
6,434,950 B2 8/2002 Newman et al. ..... 62/63
6,557,367 B1 5/2003 Lang et al. ..... 62/380
6,877,327 B2 * 4/2005 Newman et al. ..... 62/64

FOREIGN PATENT DOCUMENTS

EP 1376036 A1 * 1/2004
JP 2002-39662 A * 2/2002

* cited by examiner

*Primary Examiner*—Mohammad M. Ali
(74) *Attorney, Agent, or Firm*—Robert J. Hampsch

(57) ABSTRACT

Apparatus and methods for cooling or heating product by passing it through a tunnel in which gaseous heat transfer medium such as cryogen vapor or steam is impinged toward the product and then drawn away from the product in a manner that minimizes intersection with impinging medium.

21 Claims, 5 Drawing Sheets

COOLING OR HEATING WITH MULTI-PASS FLUID FLOW

FIELD OF THE INVENTION

The present invention relates to apparatus and methods for cooling or heating products such as food products. The present invention relates more particularly to apparatus and methods for this purpose which employ a cryogen such as liquid nitrogen for cooling (including freezing) or employ a hot gaseous heat transfer medium such as steam for heating (including cooking).

BACKGROUND OF THE INVENTION

Many devices have been disclosed and commercially employed over the years which cool or heat products by passing the product to be cooled or heated into an entrance opening of a device, conveying the product through the interior of the device where it is exposed to a cold or hot atmosphere, depending on the object to be achieved, and recovering the cooled or heated product from an exit of the apparatus. In some embodiments, the interior atmosphere is established by mechanical units which chill or heat the ambient air within the unit. In other embodiments, jets of cooled or heated air or vapor are directed at the product to be cooled or heated, in the attempt to increase the rate of heat transfer from or to the product, thereby reducing the amount of time that is required to achieve the desired degree of cooling or heating of the product.

The literature includes examples of apparatus in which the heat transfer medium, such as cryogen vapor or heated air, is impinged upon the surface of the product being cooled or heated. Recent examples of such literature include U.S. Pat. No. 6,263,680 and U.S. Pat. No. 6,434,950. However, examples such as these still suffer from a lack of efficiency in the heat transfer that can be attained in the course of carrying out cooling or heating by impingement of heat transfer medium.

Thus, there remains a need in this field for improved apparatus and methods for cooling and heating articles employing impingement techniques.

BRIEF SUMMARY OF THE INVENTION

One aspect of the present invention is an apparatus useful for cooling a product, comprising (A) a housing comprising an elongated tunnel having a product entrance and a product exit, a conveyor belt for carrying product inside and through said tunnel from said entrance to said exit, said belt having upper and lower surfaces and first and second side edges and, within said housing, (B) liquid cryogen injection apparatus for applying liquid cryogen to product on the upper surface of said belt;

(C) an exhaust port, including an exhaust fan, through which cryogen vapor can be withdrawn from said housing by the action of said exhaust fan, (D) upper impingement structure above said belt, and a unitary plenum that comprises the space above said upper impingement structure and the space outside the first side edge of said belt;

(E) return space outside the second edge of said belt;

(F) the upper impingement structure comprising a plurality of concave troughs opening toward the belt and terminating at trough edges aligned side by side across the direction of travel of said belt so that between each pair of adjacent troughs there is a flow space having a top that is in fluid communication with said plenum, sides that are between respective ends of adjacent troughs, and an impingement slot that is between terminal edges of adjacent troughs, wherein terminal trough edges terminate a distance above the belt surface to define impingement zones, located between the impingement slot of a flow space and the belt surface, through which product to be cooled or frozen can pass on said belt;

(G) barrier structure between said plenum and said return space that prevents vapor flow through the sides of said flow spaces that are closer to said second side edge of said belt into the return space and that prevents vapor flow through the sides of said impingement zones that are closer to said second side edge of said belt into the return space; and (H) a plurality of circulation fans located along the length of the housing which can draw cryogen vapor from said return space and impel the cryogen vapor through said fans into said plenum.

Preferably the apparatus also comprises lower impingement structure below said belt, in which case said unitary plenum comprises the space above said upper impingement structure, the space below said lower impingement structure, and the space outside the first side edge of said belt, and said belt is pervious to liquid and vapor. The lower impingement structure when present comprises a plurality of concave troughs opening toward the belt and terminating at trough edges aligned side by side across the direction of travel of said belt so that between each pair of adjacent troughs there is a flow space having a bottom that is in fluid communication with said plenum, sides that are between respective ends of adjacent troughs, and an impingement slot that is between terminal edges of adjacent troughs, wherein each impingement slot in the lower impingement structure is directly below an impingement slot in the upper impingement structure.

This preferred embodiment of the apparatus comprises even more preferably structure under said belt which can collect liquid cryogen that flows from said belt and convey it to the upstream side of one or more of said fans.

Another aspect of the present invention is an apparatus useful for heating a product, comprising (A) a housing comprising an elongated tunnel having a product entrance and a product exit, a conveyor belt for carrying product inside and through said tunnel from said entrance to said exit, said belt having upper and lower surfaces and first and second side edges and, within said housing, (B) injection apparatus for applying hot gaseous medium to product on the upper surface of said belt;

(C) an exhaust port, including an exhaust fan, through which gaseous medium can be withdrawn from said housing by the action of said exhaust fan, (D) upper impingement structure above said belt, and a unitary plenum that comprises the space above said upper impingement structure and the space outside the first side edge of said belt;

(E) return space outside the second edge of said belt;

(F) the upper impingement structure comprising a plurality of concave troughs opening toward the belt and terminating at trough edges aligned side by side across the direction of travel of said belt so that between each pair of adjacent troughs there is a flow space having a top that is in fluid communication with said plenum, sides that are between respective ends of adjacent troughs, and an impingement slot that is between terminal edges of adjacent troughs, wherein terminal trough edges terminate a distance above the belt surface to define impingement zones, located between the impingement slot of a flow space and the belt surface, through which product to be heated can pass on said belt;

(G) barrier structure between said plenum and said return space that prevents flow of gaseous medium through the sides of said flow spaces that are closer to said second side edge of said belt into the return space and that prevents flow of gaseous medium through the sides of said impingement zones that are closer to said second side edge of said belt into the return space; and (H) a plurality of circulation fans located along the length of the housing which can draw gaseous medium from said return space and impel the gaseous medium through said fans into said plenum.

Preferably the apparatus also comprises lower impingement structure below said belt, in which case said unitary plenum comprises the space above said upper impingement structure, the space below said lower impingement structure, and the space outside the first side edge of said belt, and said belt is pervious to liquid and vapor. The lower impingement structure when present comprises a plurality of concave troughs opening toward the belt and terminating at trough edges aligned side by side across the direction of travel of said belt so that between each pair of adjacent troughs there is a flow space having a bottom that is in fluid communication with said plenum, sides that are between respective ends of adjacent troughs, and an impingement slot that is between terminal edges of adjacent troughs, wherein each impingement slot in the lower impingement structure is directly below an impingement slot in the upper impingement structure.

Another aspect of the present invention is a method for cooling an object, comprising passing the object through an enclosure on a belt and, while the item is passing through the enclosure, (A) spraying liquid cryogen onto the object, whereby cryogen vapor forms;

(B) impinging the cryogen vapor onto the object from a plurality of impingement slots situated between concave troughs that open toward the object and then drawing the impinged cryogen vapor from the object into the troughs while minimizing flow of the impinged cryogen vapor off of side edges of said belt without passing into said troughs; and (C) recirculating the cryogen vapor from said troughs to and through said impingement slots a plurality of times before withdrawing said cryogen vapor from said enclosure.

Another aspect of the present invention is a method for heating an object, comprising passing the object through an enclosure on a belt and, while the item is passing through the enclosure, (A) spraying hot gaseous medium onto the object;

(B) impinging the gaseous medium onto the object from a plurality of impingement slots situated between concave troughs that open toward the object and then drawing the impinged gaseous medium from the object into the troughs while minimizing flow of the impinged gaseous medium off of side edges of said belt without passing into said troughs; and (C) recirculating the gaseous medium from said troughs to and through said impingement slots a plurality of times before withdrawing said gaseous medium from said enclosure.

As used herein, "cooling" something means withdrawing heat from it. Thus, "cooling" includes lowering the temperature of a product and also includes withdrawing heat from a product even as the temperature of the product remains unchanged, such as occurs upon freezing.

As used herein, "heating" something means adding heat to it. Thus, "heating" includes raising the temperature of a product and also includes adding heat to a product even as the temperature of the product remains unchanged, such as can occur upon cooking a product, or upon evaporating a liquid from a product, or upon evaporating a product that is a liquid.

DETAILED DESCRIPTION OF THE INVENTION

Figure 1:
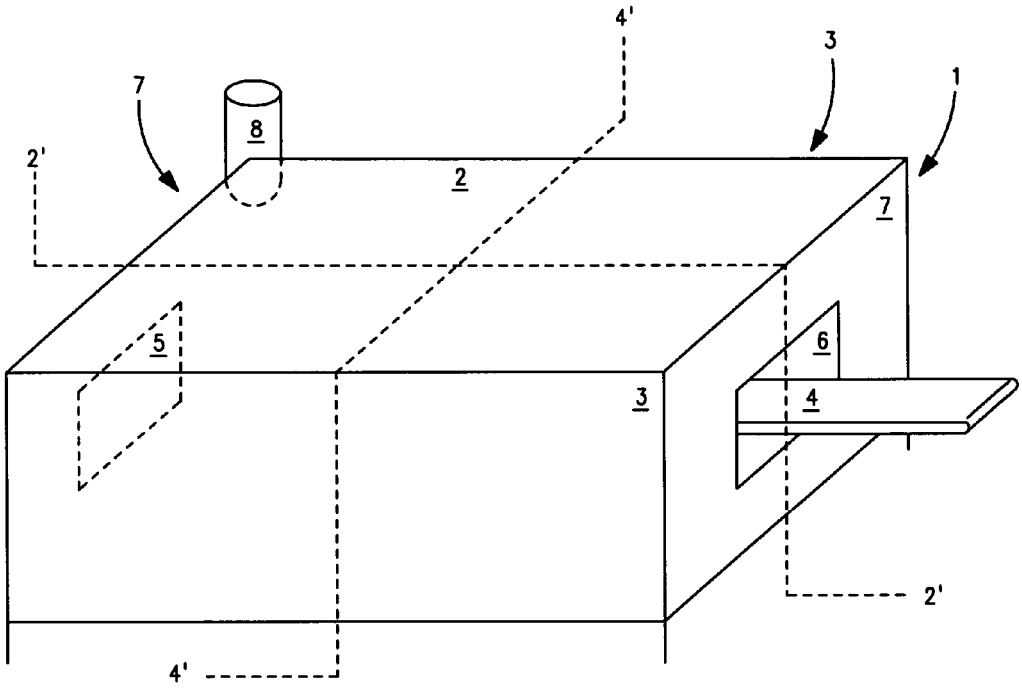
FIG. 1 is a perspective view of the exterior of an apparatus according to the present invention.

The invention is preferably carried out using apparatus having the general physical configuration shown in FIG. 1. As seen in FIG. 1, housing 1 includes top 2, sides 3 and ends 7. The housing can be constructed so that one or both sides can be removed, or can be swung upward on suitably placed hinges, to provide access to the interior for cleaning and maintenance.

A continuous belt 4 of conventional design passes from entrance 5 through the housing and emerges at exit 6. The opposed ends of belt 4 can be aligned with entrance 5 and exit 6, or can protrude out of the housing at entrance 5, exit 6, or both, as desired by the operator to facilitate loading and unloading product onto and off of the belt. Belt 4 is made of any material that can withstand the temperatures to which it is exposed within housing 1, and that can withstand having the heat transfer medium (e.g. a very cold material such as liquid nitrogen for cooling applications, or a hot material such as steam at several hundred degrees Celsius, depending on whether the apparatus is constructed to provide cooling or heating) applied directly onto the belt material. At least in those embodiments in which heat transfer medium is impinged toward the belt from above and below the belt surface, the belt 4 should be constructed so that liquid and vapor can pass through it. One well-known example of such belt material comprises interlinked loops of metal mesh. Other examples are conventional and well-known in this field.

Figure 2:
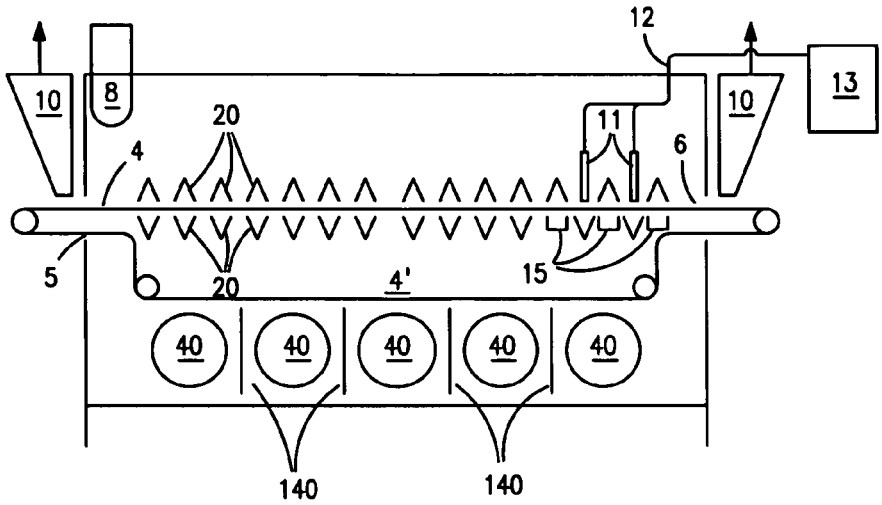
FIG. 2 is a cross-sectional view of apparatus according to the present invention, taken along the line 2'—2' of FIG. 1.

FIG. 2 shows in cross-sectional view a representative apparatus with which the present invention can be practiced. Injectors 11 are situated near one end of the housing. Injectors 11 spray heat transfer medium toward the upper surface of belt 4 and onto product that is being carried through the housing on belt 4. When the function of the apparatus is to cool product, the heat transfer medium applied by injectors 11 is preferably liquid cryogen. By "cryogen" is meant any compound or composition which vaporizes (at a pressure of 1 atmosphere) at −50 F. or lower. When the function of the apparatus is to heat product, the heat transfer medium is preferably a gas, such as steam, which is at a temperature of 100 to 300 C. The embodiment shown in FIG. 2 is typically used for applying liquid nitrogen to cool products. The injectors 11 can instead be arrayed along more of the length of the tunnel. Indeed, liquid carbon dioxide can be employed as the heat transfer medium in cooling applications, and is preferably applied from injectors 11 arrayed along most of the length of the tunnel. Injectors 11 are supplied with heat transfer medium through lines 12 from source 13 outside housing 1. For cooling applications, source 13 is typically an insulated tank that contains the liquid cryogen. For heating applications, source 13 can be a steam generator.

The interior of housing 1 also contains a zone in which are situated a plurality of concave troughs 20. In the preferred embodiment as show in FIG. 2, the plurality of concave troughs are provided both above belt 4 and below belt 4. In other embodiments, it is possible to carry out the invention using only troughs situated above belt 4. The returning path of the belt includes portion 4'.

Near the end of the housing furthest from the injectors 11 is exhaust port 8, which includes an exhaust fan, a duct which contains an adjustable damper by which the amount of gaseous heat transfer medium that leaves the housing can be adjusted, and appropriate control means (described below) for adjusting the amount of gaseous heat transfer medium that is withdrawn from the housing by adjustment of the speed of the exhaust fan, the position of the damper, or both, so as to achieve the desired amount of cooling or heating.

For cooling applications, it is preferred to provide pans 15 for collecting liquid cryogen that are situated beneath belt 4 to facilitate collecting liquid cryogen applied by injectors 11 that does not vaporize upon contact with the belt 4 and with the products on belt 4. These pans are described more fully below with respect to FIG. 3.

FIG. 2 also depicts a plurality of circulation fans 40 that are also provided within the housing. These fans and their function are described more fully hereinbelow. Vanes 140 are preferably situated between adjacent fans. As seen better in FIGS. 4 and 7, each vane 140 extends into the interior of the tunnel. More preferably, each vane 140 is hingedly attached to the side of the housing so that each vane can be positioned to be perpendicular to the side of the housing or to be positioned to form an angle to that perpendicular so that the vane extends toward the stream of current exiting one of the adjacent fans and away from the stream exiting the other adjacent fan.

External exhaust fans 10 shown in FIG. 2 are preferably provided, to draw off gaseous heat transfer medium that would otherwise escape into the areas outside the apparatus. This capability is especially useful when the apparatus is situated in a room within a building, because heat transfer medium (such as cold cryogen vapor or steam) that has escaped from the apparatus can be uncomfortable to people working in the vicinity of the apparatus, and can require excessive conditioning of the ambient atmosphere to compensate for the effect of the escaped medium on the temperature of the air in the room. The arrowed lines from the units 10 indicate piping which conveys the gaseous heat transfer medium, usually combined with ambient air, to where it is vented away from the apparatus and preferably outside the building.

In the preferred mode of operating, belt 4 moves in a direction such that product enters housing 1 at entrance 5 and leaves housing 1 at exit 6 so that product moves through housing 1 in a direction which is countercurrent to the direction of flow of gaseous heat transfer medium from its point of introduction at injectors 11 to exhaust port 8. However, if desired, an operator may operate the belt so that product moves in a direction cocurrent with the direction in which gaseous heat transfer medium flows within housing 1.

Figure 3:
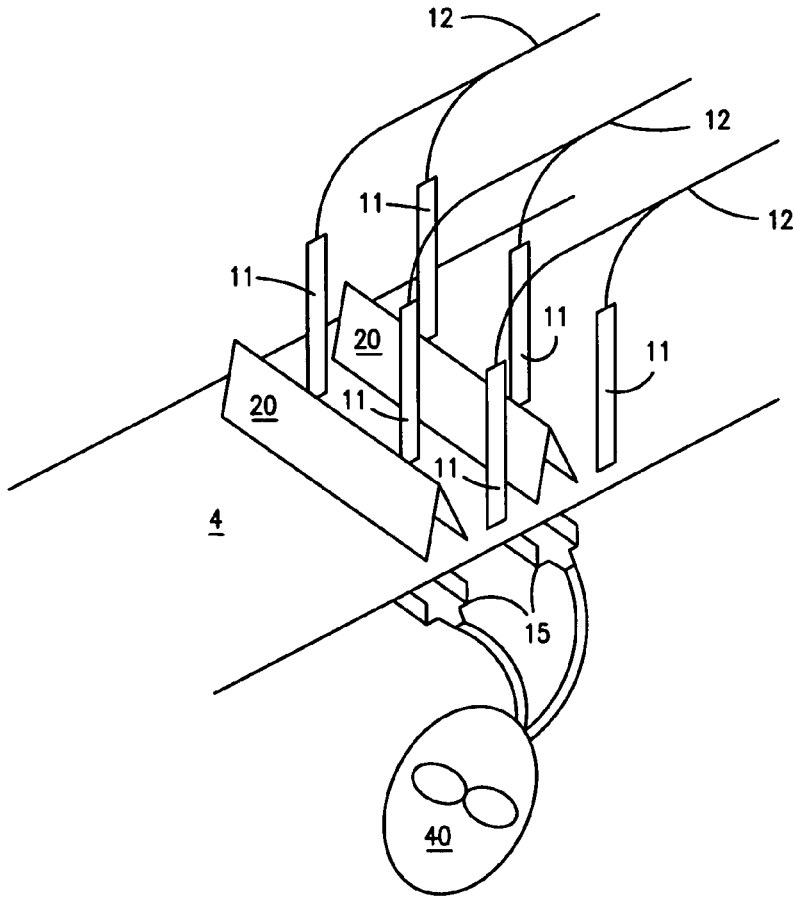
FIG. 3 is a close-up perspective view of a portion of the view of FIG. 2.
Figure 4:
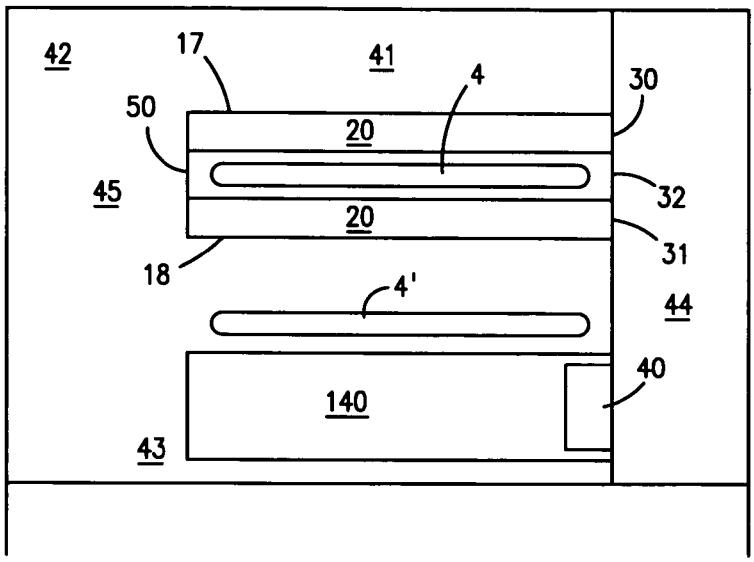
FIG. 4 is a cross-sectional view of apparatus according to the present invention, taken along the line 4'—4' of FIG. 1.

FIG. 3 provides more illustration of the zone within the housing where the heat transfer medium is injected. As can be seen, a plurality of injectors 11 are preferably arrayed across the width of belt 4, in order in insure that the heat transfer medium contacts all product on belt 4 that is passing through housing 1. In operations in which liquid cryogen is applied from injectors 11, pans 15 as seen in greater detail in FIG. 3 are located below belt 4, so that liquid cryogen applied from the nozzles 11 that does not vaporize can be collected in pans 15. The pans 15 preferably permit the liquid cryogen to flow out from under belt 4, into return space 44 (which is seen in FIG. 4) which is situated upstream from the circulation fans 40. More preferably, the pans 15 are connected to an associated conduit through which the liquid cryogen can flow freely from pan 15 directly into the upstream side of a circulation fan 40. The liquid vaporizes as it passes through the fan. In this way, the cooling capacity of the liquid cryogen is used to greater advantage in providing more efficient cooling and freezing of products.

FIG. 4 is a cross-sectional view of the apparatus of the present invention, looking along the length of belt 4. In the embodiment shown in FIG. 4, upper impingement structure 17 is situated above belt 4, and lower impingement structure 18 is situated below belt 4. Space 50 between impingement structures 17 and 18, at a side edge of belt 4, is preferably closed off by a structural element such as a strip of metal, thereby retarding or preventing vapor from entering the space above the belt upper surface in a direction across the belt surface and across product on the belt.

In an alternative embodiment space 50 can be occupied by a structural element that partially retards flow of gaseous heat transfer medium in such a direction, but permits a small amount of flow in that direction. Such a structural element can be a strip of metal that contains perforations through it, Plenum 42 comprises the space 41 above upper impingement structure 17, the space 43 below lower impingement structure 18, and the space 45 outside one side edge of belt 4. Preferably, plenum 42 is unitary, by which is meant that the spaces 41, 43 and 45 are open to one another without any barrier or orifice impeding the flow of gaseous heat transfer medium to and from spaces 41, 43 and 45, and by which is further meant that there is no structure such as divider plates, baffles, or other physical structure impeding the flow of gaseous heat transfer medium within space 41 above the upper impingement structure in a direction parallel to the path of travel of belt 4.

FIG. 4 also shows a circulation fan 40, and return space 44 upstream from circulation fan 40. Return space 44 is separated from plenum 42 by structure, including the barriers referred to by numerals 30, 31 and 32 in FIG. 4 which structure is described and illustrated further herein with respect to FIG. 6. Circulation fan 40, and the other fans 40 situated along the length of housing 1 as shown in FIG. 2, draw gaseous heat transfer medium (e.g. cryogen vapor or steam) into return space 44 in the manner and along the pathway described hereinbelow, and they impel the gaseous heat transfer medium from return space 44 into plenum 42 so that it can be recirculated to and through the impingement structures toward belt 4. The axes of circulation fans 40 are preferably horizontal but may be angled to the horizontal.

Vanes 140 (one of which is shown on FIG. 4) help direct flow of gaseous heat transfer medium into the space 43 within relatively distinct regions defined by the vanes, so that a stream exiting from each fan into space 43 is not interfered with by the streams from adjacent fans or by the overall flow of gaseous heat transfer medium progressing generally from the injection nozzles 11 toward the exhaust 8.

Figure 7:
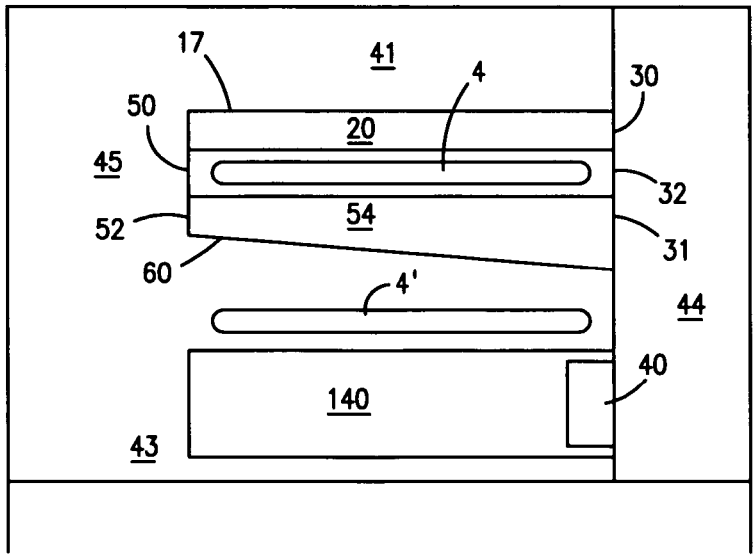
FIG. 7 is a cross-sectional view of an alternate embodiment of apparatus according to the present invention.
Figure 6:
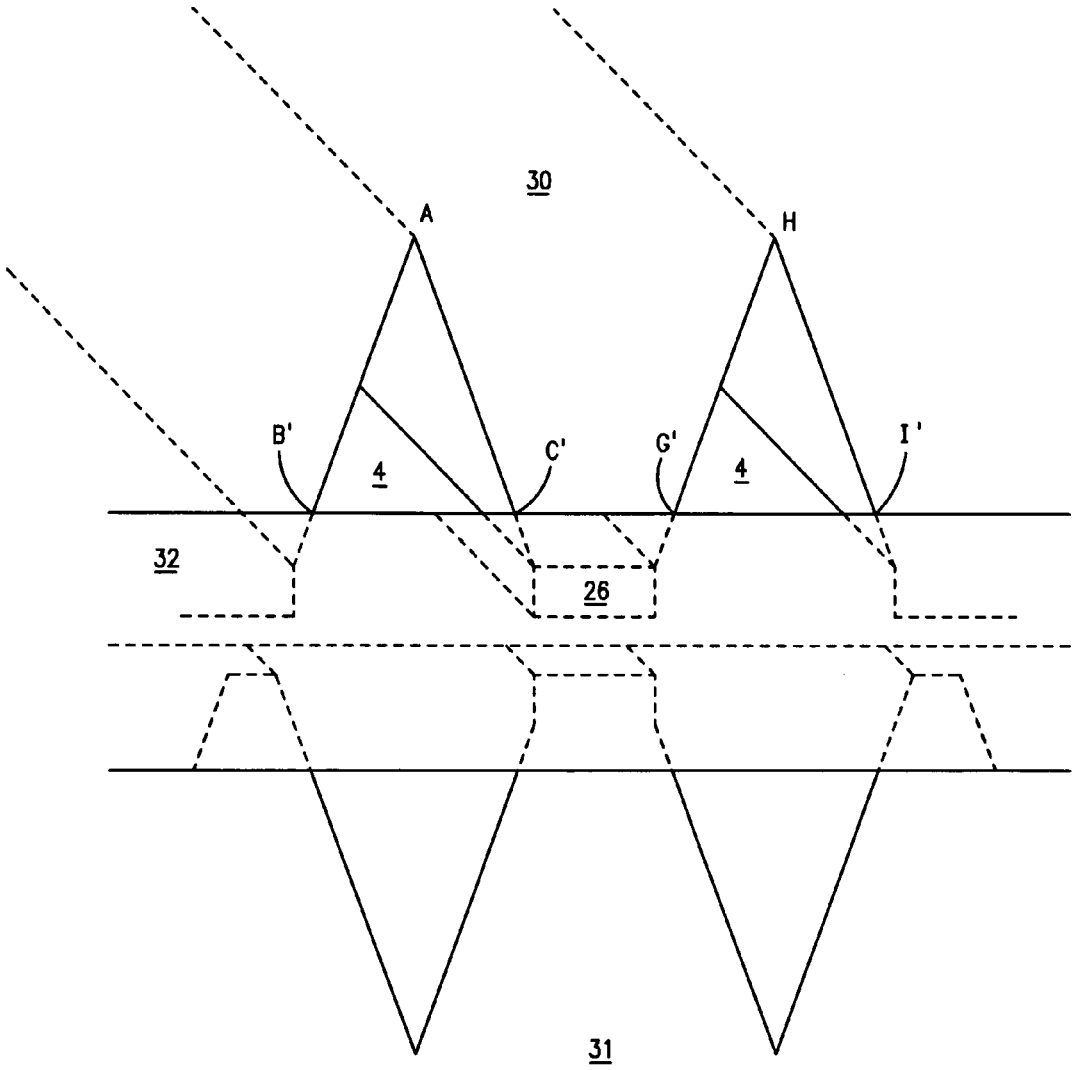
FIG. 6 is a close-up perspective view of FIG. 5 but with additional structure present.

In another alternate embodiment of the invention, illustrated in FIG. 7, upper impingement structure 17 is present but no lower impingement structure is present. That is, no concave troughs 20 are present below belt 4. A solid plate 60 is provided below belt 4. Plate 60 extends along the length and width of belt 4 and defines space 54 below belt 4. Space 54 is also defined by side plate 52 which closes off space 54 against entry of gaseous heat transfer medium directly from plenum space 45. Plate 60 extends to barrier structure 31. Openings are provided in barrier structure 31 such as the openings therein that are shown in FIG. 6. In this embodiment, belt 4 can be supported on a porous plate (not separately shown).

Figure 5:
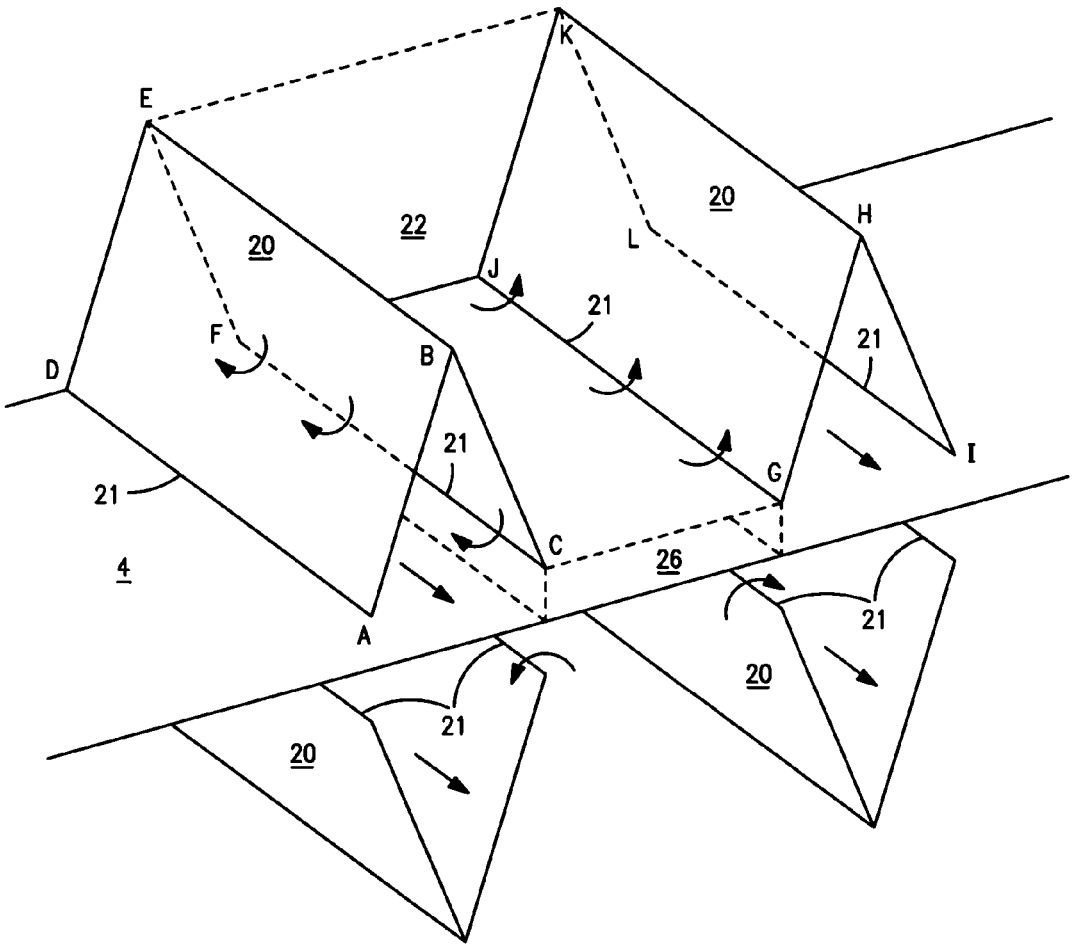
FIG. 5 is a close-up perspective view of a portion of the apparatus of the present invention but with some structure removed.

Impingement structures useful in this invention are described in greater detail with reference to FIGS. 5 and 6. FIG. 5 illustrates a considerably enlarged representation of the impingement structures. FIG. 5 illustrates fewer than all of the components of the complete structure of the apparatus, so that the illustrated components can be seen better. FIG. 5 shows two adjacent concave troughs 20 above belt 4, and two more concave troughs below belt 4. In actual operation, each of these concave troughs 20 would be longer, and belt 4 would be wider. In addition, in actual operation, adjacent pairs of concave troughs 20 would likely be closer together, but they are shown in FIG. 5 a greater distance apart to facilitate description of their various features.

Each of the concave troughs 20 extends transversely across the direction of travel of belt 4, and preferably perpendicular to that direction of travel. The concave troughs can have a shape like that shown in FIGS. 2 and 4 which in cross-section resembles a V or inverted V. However, the concave troughs can have other shapes, such as a shape which in cross-section resembles a U or inverted U, that define and partially enclose a space. As a matter of terminology, an item is "concave" if a straight line can be drawn that intersects a surface of the item at two points without passing through the item, and the "interior" of the concave item is the space through which any such line passes. The concave item "opens toward" structure to which a straight line can be drawn from the surface that contacts the "interior" without passing through the concave item.

Each concave trough 20 comprises terminal edges 21. In the two troughs 20 illustrated in FIG. 5 that are above belt 4, the terminal edges 21 are along the bottom of the troughs 20, whereas in the two troughs 20 that are below belt 4, their terminal edges are at the upper edge of each of those troughs 20. As can be seen, the corners of the two troughs 20 that are above belt 4 in FIG. 5 are also identified by letters. Thus, the terminal edges of one of the troughs 20 are respectively segments AD and CF. Likewise, the terminal edges of the other concave trough 20 that is above belt 4 comprise the segments GJ and IL. The terminal edges of the troughs 20 that are below belt 4 are in analogous positions, but at the upper extent of those troughs so as to be adjacent to belt 4.

Between each pair of adjacent concave troughs 20, such as the two concave troughs illustrated in FIG. 5 above belt 4, a flow space 22 is defined therebetween. Referring to the lettered corners in FIG. 5, the flow space between the two concave troughs 20 is the space whose top is the opening bounded by corners BEKH, whose sides are bounded by corners BCGH and EFJK, and whose bottom forms an impingement slot bounded by corners CGJF. Impingement zone 26 is illustrated with dotted lines and is the space directly below impingement slot CGJF and above the top surface of belt 4.

The ends of the concave troughs 20 are defined by corners ABC and corners DEF for one of the troughs above belt 4 illustrated in FIG. 5, and by corners GHI and corners JKL in the other of those troughs 20.

The flow spaces between adjacent concave troughs 20 that are below belt 4, the ends of respective adjacent pairs of concave troughs 20 below belt 4, and the impingement slots below belt 4, are defined in the same manner as set forth herein for the concave troughs illustrated in FIG. 5 that are above belt 4.

FIG. 6 depicts the apparatus fully assembled so as to operate in the improved, more efficient manner of the present invention. Structure 30, which can be a suitably dimensioned piece of sheet metal, is attached to the concave troughs 20 at one end of each trough, so that one side of the flow space (such as the side bounded by corners BCGH in FIG. 5) as well as the space 41 above the top of that flow space, is sealed off so that gaseous heat transfer medium cannot flow through that side of the flow space into space 44. Because of structure 30, gaseous heat transfer medium that enters flow space 22 cannot pass out through that side but must instead pass downward through impingement slot 25 (defined, for instance, by corners CFJG in FIG. 5) and into impingement zone 26.

FIG. 6 also shows structure 32 which closes off the side of impingement zone 26 that aligns with the side of flow space 22 that is closed off by structure 30. Structure 32 prevents gaseous heat transfer medium that has passed into impingement zone 26 from leaving impingement zone 26 off of the side edge of belt 4, into return space 44, in a direction transverse to the direction of movement of product along belt 4. Instead, structure 32 requires gaseous heat transfer medium that has passed into impingement zone 26 and impinged upon product on belt 4 to pass under the terminal edges of the concave troughs 20, in the direction shown by the curved arrows in FIG. 5. The gaseous heat transfer medium thus flows along the direction of movement of products on belt 4, passing into the concave spaces that are defined by the troughs 20. As can be seen in FIG. 6, when barrier structures 30 and 32 are in place the ends of the concave troughs themselves are open so that gaseous heat transfer medium having entered the concave space within each trough 20 can flow out through the end of the trough, into space 44. The portion of the end of the trough that is open can be equal to the entire end which is defined in FIG. 5 by corners ABC, or structure 32 can be somewhat larger so that the open spaces at the ends of the troughs are smaller in size such as are defined by corners AB'C' and HG'I' in FIG. 6.

When the invention is practiced with embodiments that include lower impingement structure 18, structure 31 should also be provided that prevents flow of gaseous heat transfer medium into return space 44 from the flow spaces that are between the troughs 20 that are below belt 4, and that prevents flow of gaseous heat transfer medium from plenum space 43 out the ends of the troughs 20 into return space 44.

The function that is provided by barrier structures 30, 31 and 32 can be provided by several pieces of metal, or by a single piece which is suitably dimensioned to fit as necessary onto that side of the impingement structures.

In operation of the apparatus to cool a product, liquid cryogen is injected through injectors 11 toward the upper surface of belt 4 and product thereon. With the circulation fans 40 and exhaust means 8 operating, cryogen vapor that is formed by vaporization of the injected cryogen liquid flows into return space 44 through openings in barrier structure 30 and is drawn to the inlet of one or more of the circulation fans 40. Liquid cryogen that does not vaporize upon contact with the belt or with product on belt 4 flows through belt 4 into pans 15 from where it flows o the inlet of one or more of the circulation fans 40 and is vaporized when it passes through that fan.

In actual operation of the apparatus to heat a product, hot gaseous medium such as steam is injected through injectors 11 toward the upper surface of belt 4 and product thereon. With the circulation fans 40 and exhaust means 8 operating, the steam flows into return space 44 through openings in barrier structure 30 and is drawn to the inlet of one or more of the circulation fans 40.

The cryogen vapor or hot heat transfer medium, as the case may be, then proceeds through a path from the outlet of circulation fans 40 into plenum space 43. A portion of the gaseous heat transfer medium flows from plenum space 43 into and through plenum space 45 into plenum space 41 and into the flow spaces in upper impingement structure 17, where it follows the path indicated by arrows in FIG. 5 into the concave spaces that are defined by the concave troughs 20 that are above belt 4. Some of this gaseous heat transfer medium may instead flow through belt 4 and then into the concave spaces defined by concave troughs that are located below belt 4. Another portion of the gaseous heat transfer medium flows from plenum space 43 upwards to the bottom of lower impingement structure 18 and through the flow spaces and impingement slots in impingement structure 18 toward the lower surface of belt 4, and then into the concave spaces that are defined by concave troughs that are located below belt 4. Some of this gaseous heat transfer medium may instead pass through belt 4 and enter the concave spaces that are above belt 4.

Gaseous heat transfer medium that has passed into concave spaces above and below belt 4 then passes out the ends of the concave troughs through openings in barrier structures 30 and 31 into return space 44, and then to the inlets of circulation fans 40 which drive the gaseous heat transfer medium through the fans into plenum space 43 again.

Under the influence of the circulating fans 40, gaseous heat transfer medium repeatedly follows this pathway as it progresses along the length of the belt under the influence of the exhaust fan in exhaust means 8. That is, the gaseous heat transfer medium recirculates and reimpinges onto the belt 4 many times as it passes along the length of belt 4.

When the fans are operating in the embodiment shown in FIG. 7, the gaseous heat transfer medium circulates in a path from the outlet of circulating fans 40 into and through plenum spaces 43 and 45 into plenum space 41, then downward through upper impingement structure 17 and the impingement slots therein toward the upper surface of belt 4. A portion of the gaseous heat transfer medium flows in the manner shown in FIG. 5, that is, into the concave spaces above belt that are defined by the troughs 20, then out the ends of the concave spaces into return space 44. Another portion of the gaseous heat transfer medium that was impinged toward the upper surface of belt 4 passes through belt 4 into space 54 and then through openings in barrier structure 31 into return space 44. The gaseous heat transfer medium that enters return space 44 from either of the indicated pathways is then drawn to the inlet of circulating fans 40 and is driven through those fans.

The pathways that the gaseous heat transfer medium follows in the embodiments of the present invention provide cooling or heating in a manner that is superior in terms of the amount of heat transfer attained from the product per amount of heat transfer medium employed, and in terms of the amount of cooling or heating attained in a given length of tunnel. A significant factor contributing to this superiority is the fact that gaseous heat transfer medium which has impinged onto product on belt 4 is significantly or completely prevented by the barrier structures 30, 31 and 32 from being drawn to flow along a path toward the side edges of the belt. Gaseous heat transfer medium flowing along such a path would intersect with other gaseous heat transfer medium impinging toward the product on the belt, and would deflect the impinging gaseous heat transfer medium from its desired path directly toward the product. Such deflection would reduce the velocity of the impinging stream toward the product and would thereby reduce the effectiveness of the impingement in effecting more efficient heat transfer.

In addition, in cooling applications cryogen vapor having impinged onto the product would have removed some heat from the product, and would thus be warmer than vapor just emerging from the impingement slots toward the product, so that intersection of the transverse and impinging flows of vapor would raise the temperature of the impinging flow and thereby reduce its ability to effect heat transfer from the product even before it has reached the product surface. Instead, in accordance with the present invention, the vapor that has impinged onto the product surface is colder, and having impinged is drawn into the concave spaces before it is drawn out the ends of the concave troughs. The vapor drawn away in such a manner does not interfere with the velocity vector of other impinging vapor, thereby enhancing heat transfer from the product to the impinging vapor, and does not raise the temperature of the impinging vapor by commingling with it.

Similarly, in heating applications the hot heat transfer medium (such as steam) having impinged onto the product would have added some heat to the product, and would thus be cooler than e.g. steam just emerging from the impingement slots toward the product, so that intersection of the transverse and impinging flows of e.g. steam would lower the temperature of the impinging flow and thereby reduce its ability to effect heat transfer to the product even before it has reached the product surface. Instead, in accordance with the present invention, the gaseous medium that has impinged onto the product surface is still hotter, and having impinged is drawn into the concave spaces before it is drawn out the ends of the concave troughs. The gaseous medium drawn away in such a manner does not interfere with the velocity vector of other impinging gaseous medium, thereby enhancing heat transfer to the product from the impinging medium, and does not lower the temperature of the impinging medium by commingling with it.

Furthermore, just as drawing the impinged stream into the concave spaces defined by e.g. troughs 20 prevents the stream from interfering with the effectiveness of ensuing impingement, the stream once it has been drawn into the concave spaces is available to provide additional heat transfer, and without interference from impinging streams. That is, as the stream is drawn transversely along the concave spaces and out through the ends of those spaces, additional heat transfer is effected between those streams and the product, and that heat transfer is not disrupted by the impingement of additional heat transfer medium toward the product while the transversely drawn medium is "wiping" across the surfaces of the product.

In representative operation, apparatus embodying this invention is generally at least about 6 feet in length. There is no absolute maximum length for successful operation; rather, the length is typically set by the desired dwell time of product passing through the tunnel and by the available space in which the apparatus would be operated. Generally, the apparatus is 20 to 50 feet long.

The number of circulation fans 40 to employ depends mainly on the length of the apparatus. The circulation fans should be spaced about 3 to 5 feet apart. The concave troughs should be spaced apart so that the distance across an impingement slot from one trough to the next is about 1 inch. The flow spaces are typically about 3 to 8 inches high.

The number of times that gaseous heat transfer medium is reimpinged to the belt as it passes through the apparatus can vary in a large range but 2 to 100 times, preferably 5 to 60 times, are achievable and useful. The speed of the circulation fans 40 and the dimensions of the impingement slots determine the flow rate of gaseous heat transfer medium through the impingement slots. A preferred flow rate, to achieve a satisfactory heat transfer, is in the range of 3 to 20 meters per second.

The exhaust port 8 is employed to control the prevailing temperature within the tunnel. Of course, the ongoing introduction of product to be cooled or heated requires ongoing introduction of heat transfer medium into the tunnel. A material balance of heat transfer medium injected and exhausted must be maintained.

A control system for exhaust port 8 is provided that removes the majority of the gaseous heat transfer medium present in the tunnel, preferably removes 70–90% of it, and more preferably removes about 80% of it. The remaining portion of the gaseous heat transfer medium exits out the ends 5 and 6 of the tunnel and is drawn off by fans 10 with diluting room air. The positioning of exhaust port 8 provides two beneficial effects. It can cause a decrease in the pressure in the low pressure side of the tunnel which will increase the impingement velocity of vapor onto the product and increase the amount of heat transfer from or to the product. It also causes a decrease in the fan energy required by the fans to produce the spiraling flow of gaseous heat transfer medium in the tunnel. The fan that removes gaseous heat transfer medium at exhaust port 8 must be capable of operating at the temperatures to which it will be exposed, e.g. −200 F. in units used for cooling and 100 to 300 F. in units used for heating The fan used in exhaust port 8 has a variable speed motor whose speed is controlled to match the amount of heat transfer medium injected into the system, taking into account a short time delay whose magnitude is a function of the length of the tunnel from the injection point to the location of the exhaust port. The signal which determines the fan speed comes from a control valve that governs flow of heat transfer medium (i.e. liquid cryogen or steam, as the case may be) to the injectors 11. From the control valve characteristics, inlet pressure, and position a theoretical mass flow of heat transfer medium can be determined for any valve position. This allows the exhaust fan to be sized properly. If the control valve is opened 100% the speed of the fan at exhaust port 8 is adjusted to draw through the fan 80% of the gaseous heat transfer medium vapor in the tunnel. This relationship is primarily linear and the speed of this fan is controlled as a simple ratio to the injection control valve position.

The gaseous heat transfer medium that does not leave the tunnel through the fan of exhaust port 8 leaves at the ends 5 and 6 of the tunnel. The control of the gaseous heat transfer medium coming out the tunnel ends is provided by the positioning of flow dampers in the end fans 10. These dampers allow a portion of the gaseous heat transfer medium from the plenum space 41 to create a vapor curtain at the ends, thereby helping to prevent infiltration of room air which is a source of inefficiency and plugging of the impingement nozzles with water ice. The dampers in each end fan 10 are adjusted such that a small amount of gaseous heat transfer medium exits from each end of the tunnel. This ensures that the mass flow of heat transfer medium is balanced and that a minimal amount of room air enters the tunnel. This system also has the advantage of dramatically reducing the amount of conditioned room make up air that a typical operator will have to supply to the room and building in which the apparatus is located.

What is claimed is:

1. Apparatus useful for cooling or freezing a product, comprising (A) a housing comprising an elongated tunnel having a product entrance and a product exit, a conveyor belt for carrying product inside and through said tunnel from said entrance to said exit, said belt having upper and lower surfaces and first and second side edges and, within said housing, (B) liquid cryogen injection apparatus for applying liquid cryogen to product on the upper surface of said belt;

(C) an exhaust port, including an exhaust fan, through which cryogen vapor can be withdrawn from said housing by the action of said exhaust fan, (D) upper impingement structure above said belt, and a unitary plenum that comprises the space above said upper impingement structure and the space outside the first side edge of said belt;

(E) return space outside the second edge of said belt;

(F) the upper impingement structure comprising a plurality of concave troughs opening toward the belt and terminating at trough edges aligned side by side across the direction of travel of said belt so that between each pair of adjacent troughs there is a flow space having a top that is in fluid communication with said plenum, sides that are between respective ends of adjacent troughs, and an impingement slot that is between terminal edges of adjacent troughs, wherein terminal trough edges terminate a distance above the belt surface to define impingement zones, located between the impingement slot of a flow space and the belt surface, through which product to be cooled or frozen can pass on said belt;

(G) barrier structure between said plenum and said return space that prevents vapor flow through the sides of said flow spaces that are closer to said second side edge of said belt into the return space and that prevents vapor flow through the sides of said impingement zones that are closer to said second side edge of said belt into the return space; and (H) a plurality of circulation fans located along the length of the housing which can draw cryogen vapor from said return space and impel the cryogen vapor through said fans into said plenum.

2. Apparatus according to claim 1 further comprising structure under said belt which can collect liquid cryogen that flows from said belt and convey it to the upstream side of one or more of said fans.

3. Apparatus according to claim 1 further comprising vertically oriented vanes between adjacent circulation fans.

4. Apparatus according to claim 1 further comprising structure under said belt which can collect liquid cryogen that flows from said belt and convey it to the upstream side of one or more of said fans, and further comprising vertically oriented vanes between adjacent circulation fans.

5. Apparatus useful for cooling or freezing a product, comprising (A) a housing comprising an elongated tunnel having a product entrance and a product exit, a conveyor belt for carrying product inside and through said tunnel from said entrance to said exit, said belt being pervious to liquid and vapor flow therethrough and having upper and lower surfaces and first and second side edges and, within said housing, (B) liquid cryogen injection apparatus for applying liquid cryogen to product on the upper surface of said belt;

(C) an exhaust port, including an exhaust fan, through which cryogen vapor can be withdrawn from said housing by the action of said exhaust fan, (D) upper impingement structure above said belt, lower impingement structure below said belt, and a unitary plenum that comprises the space above said upper impingement structure, the space below said lower impingement structure, and the space outside the first side edge of said belt;

(E) return space outside the second edge of said belt;

(F) the upper impingement structure comprising a plurality of concave troughs opening toward the belt and terminating at trough edges aligned side by side across the direction of travel of said belt so that between each pair of adjacent troughs there is a flow space having a top that is in fluid communication with said plenum, sides that are between respective ends of adjacent troughs, and an impingement slot that is between terminal edges of adjacent troughs, wherein terminal trough edges terminate a distance above the belt surface to define impingement zones, located between the impingement slot of a flow space and the belt surface, through which product to be cooled or frozen can pass on said belt;

(G) the lower impingement structure comprising a plurality of concave troughs opening toward the belt and terminating at trough edges aligned side by side across the direction of travel of said belt so that between each pair of adjacent troughs there is a flow space having a bottom that is in fluid communication with said plenum, sides that are between respective ends of adjacent troughs, and an impingement slot that is between terminal edges of adjacent troughs, wherein each impingement slot in the lower impingement structure is directly below an impingement slot in the upper impingement structure;

(H) barrier structure between said plenum and said return space that prevents vapor flow through the sides of said flow spaces that are closer to said second side edge of said belt into the return space and that prevents vapor flow through the sides of said impingement zones that are closer to said second side edge of said belt into the return space; and (I) a plurality of circulation fans located along the length of the housing which can draw cryogen vapor from said return space and impel the cryogen vapor through said fans into said plenum.

6. Apparatus according to claim 5 further comprising structure under said belt which can collect liquid cryogen that flows from said belt and convey it to the upstream side of one or more of said fans.

7. Apparatus according to claim 5 further comprising vertically oriented vanes between adjacent circulation fans.

8. Apparatus according to claim 5 further comprising structure under said belt which can collect liquid cryogen that flows from said belt and convey it to the upstream side of one or more of said fans, and further comprising vertically oriented vanes between adjacent circulation fans.

9. Apparatus useful for heating a product, comprising (A) a housing comprising an elongated tunnel having a product entrance and a product exit, a conveyor belt for carrying product inside and through said tunnel from said entrance to said exit, said belt having upper and lower surfaces and first and second side edges and, within said housing, (B) injection apparatus for applying hot gaseous medium to product on the upper surface of said belt;

(C) an exhaust port, including an exhaust fan, through which gaseous medium can be withdrawn from said housing by the action of said exhaust fan, (D) upper impingement structure above said belt and a unitary plenum that comprises the space above said upper impingement structure and the space outside the first side edge of said belt;

(E) return space outside the second edge of said belt;

(F) the upper impingement structure comprising a plurality of concave troughs opening toward the belt and terminating at trough edges aligned side by side across the direction of travel of said belt so that between each pair of adjacent troughs there is a flow space having a top that is in fluid communication with said plenum, sides that are between respective ends of adjacent troughs, and an impingement slot that is between terminal edges of adjacent troughs, wherein terminal trough edges terminate a distance above the belt surface to define impingement zones, located between the impingement slot of a flow space and the belt surface, through which product to be heated can pass on said belt;

(G) barrier structure between said plenum and said return space that prevents flow of gaseous medium through the sides of said flow spaces that are closer to said second side edge of said belt into the return space and that prevents flow of gaseous medium through the sides of said impingement zones that are closer to said second side edge of said belt into the return space; and (H) a plurality of circulation fans located along the length of the housing which can draw gaseous medium from said return space and impel the gaseous medium through said fans into said plenum.

10. Apparatus according to claim 9 further comprising structure under said belt which can collect liquid that flows from said belt and convey it to the upstream side of one or more of said fans.

11. Apparatus according to claim 9 further comprising vertically oriented vanes between adjacent circulation fans.

12. Apparatus according to claim 9 further comprising structure under said belt which can collect liquid that flows from said belt and convey it to the upstream side of one or more of said fans, and further comprising vertically oriented vanes between adjacent circulation fans.

13. Apparatus useful for heating a product, comprising (A) a housing comprising an elongated tunnel having a product entrance and a product exit, a conveyor belt for carrying product inside and through said tunnel from said entrance to said exit, said belt being pervious to vapor and liquid flow therethrough and having upper and lower surfaces and first and second side edges and, within said housing, (B) injection apparatus for applying hot gaseous medium to product on the upper surface of said belt;

(C) an exhaust port, including an exhaust fan, through which gaseous medium can be withdrawn from said housing by the action of said exhaust fan, (D) upper impingement structure above said belt, lower impingement structure below said belt, and a unitary plenum that comprises the space above said upper impingement structure, the space below said lower impingement structure, and the space outside the first side edge of said belt;

(E) return space outside the second edge of said belt;

(F) the upper impingement structure comprising a plurality of concave troughs opening toward the belt and terminating at trough edges aligned side by side across the direction of travel of said belt so that between each pair of adjacent troughs there is a flow space having a top that is in fluid communication with said plenum, sides that are between respective ends of adjacent troughs, and an impingement slot that is between terminal edges of adjacent troughs, wherein terminal trough edges terminate a distance above the belt surface to define impingement zones, located between the impingement slot of a flow space and the belt surface, through which product to be heated can pass on said belt;

(G) the lower impingement structure comprising a plurality of concave troughs opening toward the belt and terminating at trough edges aligned side by side across the direction of travel of said belt so that between each pair of adjacent troughs there is a flow space having a bottom that is in fluid communication with said plenum, sides that are between respective ends of adjacent troughs, and an impingement slot that is between terminal edges of adjacent troughs, wherein each impingement slot in the lower impingement structure is directly below an impingement slot in the upper impingement structure;

(H) barrier structure between said plenum and said return space that prevents flow of gaseous medium through the sides of said flow spaces that are closer to said second side edge of said belt into the return space and that prevents flow of gaseous medium through the sides of said impingement zones that are closer to said second side edge of said belt into the return space; and (I) a plurality of circulation fans located along the length of the housing which can draw gaseous medium from said return space and impel the gaseous medium through said fans into said plenum.

14. Apparatus according to claim 13 further comprising structure under said belt which can collect liquid that flows from said belt and convey it to the upstream side of one or more of said fans.

15. Apparatus according to claim 13 further comprising vertically oriented vanes between adjacent circulation fans.

16. Apparatus according to claim 13 further comprising structure under said belt which can collect liquid that flows from said belt and convey it to the upstream side of one or more of said fans, and further comprising vertically oriented vanes between adjacent circulation fans.

17. A method for cooling an object, comprising passing the object through an enclosure on a belt and, while the item is passing through the enclosure, (A) spraying liquid cryogen onto the object, whereby cryogen vapor forms;

(B) impinging the cryogen vapor onto the object from a plurality of impingement slots situated between concave troughs that open toward the object and then drawing the impinged cryogen vapor from the object into the troughs while minimizing flow of the impinged cryogen vapor off of side edges of said belt without passing into said troughs; and (C) recirculating the cryogen vapor from said troughs to and through said impingement slots a plurality of times before withdrawing said cryogen vapor from said enclosure.

18. A method according to claim 17 wherein said liquid cryogen comprises liquid nitrogen.

19. A method according to claim 17 wherein said liquid cryogen comprises liquid carbon dioxide.

20. A method for heating an object, comprising passing the object through an enclosure on a belt and, while the item is passing through the enclosure, (A) spraying hot gaseous medium onto the object;

(B) impinging the gaseous medium onto the object from a plurality of impingement slots situated between concave troughs that open toward the object and then drawing the impinged gaseous medium from the object into the troughs while minimizing flow of the impinged gaseous medium off of side edges of said belt without passing into said troughs; and (C) recirculating the gaseous medium from said troughs to and through said impingement slots a plurality of times before withdrawing said gaseous medium from said enclosure.

21. A method according to claim 20 where said hot gaseous medium is steam.

* * * * *